US008220227B2

(12) United States Patent
Matherly et al.

(10) Patent No.: US 8,220,227 B2
(45) Date of Patent: Jul. 17, 2012

(54) METHOD OF TRANSPORTING PARTS AND EXPANDED FOAM RETURNABLE CONTAINER

(75) Inventors: Walter Scott Matherly, Jackson, MI (US); Tetsuro Hara, Pasadena, TX (US)

(73) Assignee: Kaneka Texas Corporation, Pasadena, TX (US)

( * ) Notice: Subject to any disclaimer, the term of this patent is extended or adjusted under 35 U.S.C. 154(b) by 574 days.

(21) Appl. No.: 12/397,106

(22) Filed: Mar. 3, 2009
(Under 37 CFR 1.47)

(65) Prior Publication Data

US 2009/0223979 A1 Sep. 10, 2009

Related U.S. Application Data

(60) Provisional application No. 61/100,094, filed on Sep. 25, 2008, provisional application No. 61/033,095, filed on Mar. 3, 2008.

(51) Int. Cl.
*B65B 5/00* (2006.01)

(52) U.S. Cl. ..... 53/473; 220/660

(58) Field of Classification Search ..... 53/473, 53/235, 140; 220/660, 675, 607
See application file for complete search history.

(56) References Cited

U.S. PATENT DOCUMENTS

| | | | | |
|---|---|---|---|---|
| 3,358,725 | A * | 12/1967 | Bussard et al. | 220/9.1 |
| 3,360,180 | A * | 12/1967 | Venturi | 220/7 |
| 3,508,679 | A | 4/1970 | Semple | |
| 4,682,727 | A * | 7/1987 | Stoll | 229/114 |
| 5,114,034 | A * | 5/1992 | Miller et al. | 220/7 |
| 5,501,354 | A * | 3/1996 | Stromberg | 220/7 |
| D424,299 | S * | 5/2000 | Varfeldt | D3/309 |
| 6,409,041 | B1 * | 6/2002 | Overholt et al. | 220/669 |
| 7,152,751 | B2 * | 12/2006 | Bartasevich et al. | 220/6 |
| 7,222,745 | B2 * | 5/2007 | Gutierrez et al. | 220/675 |
| 2004/0238547 | A1 * | 12/2004 | Tyra et al. | 220/675 |

FOREIGN PATENT DOCUMENTS

| | | |
|---|---|---|
| JP | 2002-128072 A | 5/2002 |
| JP | 2005-206210 A | 8/2005 |
| JP | 2007-62764 A | 3/2007 |

* cited by examiner

*Primary Examiner* — Thanh Truong
(74) *Attorney, Agent, or Firm* — Westerman, Hattori, Daniels & Adrian, LLP

(57) ABSTRACT

The present invention provides a method of transporting parts constituting a product in a product assembly plant, the method including placing the parts in a returnable container, the returnable container being carried by a worker within the plant, wherein the returnable container is formed by expansion molding of expanded particles of a polyolefin-based resin, the relationship between the weight and volume of the returnable container satisfies Formula (1) below, and the relationship between the flexural modulus and density of the returnable container satisfies Formula (2) below:

$$650 \leqq (a-W)/W \times V \leqq 4{,}000 \quad (1)$$

(where W is the weight (kg) of the returnable container, V is the volume (L) of the returnable container, and a represents 23 kg, i.e., the maximum weight that can be carried by a worker within the plant, which is recommended by the National Institute for Occupational Safety & Health (NIOSH));

$$0.10 \leqq F/D \leqq 0.60 \quad (2)$$

(where D is the density (g/L) of the returnable container, and F is the flexural modulus (MPa) measured according to ISO 1209).

13 Claims, 7 Drawing Sheets

METHOD OF TRANSPORTING PARTS AND EXPANDED FOAM RETURNABLE CONTAINER

FIELD OF THE INVENTION

The present invention relates to a method of transporting parts constituting a product in a product assembly plant, such as an automobile assembly plant or an electrical appliance assembly plant, in which the parts are placed in a returnable container, and the returnable container is transported by a worker from one location to another within the plant, and a returnable container used for the method. More particularly, the invention relates to a method of transporting parts using a returnable container which is formed by expansion molding of expanded particles of a polyolefin-based resin, and such a returnable container.

BACKGROUND OF THE INVENTION

In a product assembly plant, such as an automobile assembly plant or an electrical appliance assembly plant, when parts are transported from a parts manufacturer's plant into the product assembly plant, when the parts transported into the assembly plant are transported to an assembly site, or when the parts are transported from the assembly site to another assembly site, usually, the parts are placed in containers and the containers are manually transported by workers. It is desired to reduce as much as possible the gross weight of a returnable container that can be transported by a worker from the standpoint of preventing the worker from suffering lower back pain and injuries. According to the National Institute for Occupational Safety & Health (NIOSH), it is recommended that the maximum gross weight of a returnable container be 51 pounds (23 kg) or less. Actually, most plants have their own rules, and in many cases, the maximum gross weight is set at 25 to 50 pounds (11.33 to 22.68 kg).

Meanwhile, returnable containers are required to have sufficient strength for carrying parts. Consequently, as such returnable containers used for transporting parts by workers in product assembly plants, containers formed by injection molding or press molding of a polyolefin resin or the like are conventionally used. In some cases, the returnable containers may be reinforced with metal fittings in order to improve strength as required. The returnable containers have a density of 900 to 1,200 g/L, depending on the resin or formulation used, and the returnable containers themselves are heavy. Consequently, the percentage of the weight of a returnable container relative to the gross weight of the returnable container that can be transported by a worker is large.

U.S. Pat. No. 3,508,679 discloses a returnable container for transporting parts from one location to another on a conveyor in a plant, the returnable container being provided with bumper elements to prevent damage which might result from succeeding returnable containers bumping into each other on the conveyor.

Japanese Unexamined Patent Application Publication Nos. 2002-128072, 2007-62764, 2005-206210, etc. disclose foamed synthetic resin containers, which are mainly used as containers for transporting seafood, vegetables, etc. As the resin used for the containers, for example, in addition to polystyrene, olefin-based resins, such as polyethylene and polypropylene, are described therein.

SUMMARY OF THE INVENTION

It is an object of the present invention to provide a method of transporting parts in a product assembly plant, in which the parts are placed in a returnable container, and the returnable container is manually transported by a worker, and a returnable container used for the method, in which, in view of the maximum gross weight of 51 pounds (23 kg) or less of a returnable container that can be carried by a worker, which is recommended by NIOSH, the volume (weight) of the parts to be contained in the returnable container can be increased as much as possible so that transportation can be performed efficiently. It is another object of the present invention to provide a method of transporting parts and a returnable container used for the method, which can reduce the occurrence of damage to the parts contained in the returnable container and worker injuries due to fingers being pinched.

The present inventors have found that, in a product assembly plant, when parts constituting a product are transported within the plant, in which the parts are placed in a returnable container, and the returnable container is carried by a worker, if a returnable container which is formed by expansion molding of expanded particles of a polyolefin-based resin is used, the weight of the returnable container itself can be reduced, and the strength of the returnable container is sufficient for carrying the parts, thus enabling more parts to be transported. That is, the problems described above can be solved by a novel method of transporting parts in a product assembly plant and preferred embodiments thereof described below.

1) A method of transporting parts constituting a product in a product assembly plant, the method including placing the parts in a returnable container, the returnable container being carried by a worker within the plant, wherein the returnable container is formed by expansion molding of expanded particles of a polyolefin-based resin, the relationship between the weight and volume of the returnable container satisfies Formula (1) below, and the relationship between the flexural modulus and density of the returnable container satisfies Formula (2) below:

$$650 \leqq (a-W)/W \times V \leqq 4{,}000 \quad (1)$$

(where W is the weight (kg) of the returnable container, V is the volume (L) of the returnable container, and a represents 23 kg, i.e., the maximum weight that can be carried by a worker within the plant, which is recommended by the National Institute for Occupational Safety & Health (NIOSH));

$$0.10 \leqq F/D \leqq 0.60 \quad (2)$$

(where D is the density (g/L) of the returnable container, and F is the flexural modulus (MPa) measured according to ISO 1209).

2) The method of transporting parts according to item 1), wherein the parts are transported within an automobile assembly plant or an electrical appliance assembly plant.

3) The method of transporting parts according to item 1), wherein the polyolefin-based resin is a polypropylene-based resin.

4) The method of transporting parts according to item 1), wherein the density D of the returnable container is 35 to 100 g/L.

5) The method of transporting parts according to item 1), wherein the returnable container has dimensions of 305 to 1,422 mm (12 to 52 inches) in length, 279 to 572 mm (11 to 22 inches) in width, and 101 to 368 mm (4 to 14 inches) in height.

6) The method of transporting parts according to item 1), wherein the maximum thickness of the returnable container is less than 50 mm.

7) A returnable container for transporting parts constituting a product in a product assembly plant, in which the parts are placed in the returnable container, and the returnable container is carried by a person from one location inside or outside the plant to another location inside the plant, wherein the returnable container is formed by expansion molding of expanded particles of a polyolefin-based resin, the relationship between the weight and volume of the returnable container satisfies Formula (1) below, and the relationship between the flexural modulus and density of the returnable container satisfies Formula (2) below:

$$650 \leqq (a-W)/W \times V \leqq 4{,}000 \quad (1)$$

(where W is the weight (kg) of the returnable container, V is the volume (L) of the returnable container, and a represents 23 kg, i.e., the maximum weight that can be carried by a worker within the plant, which is recommended by the National Institute for Occupational Safety & Health (NIOSH));

$$0.10 \leqq F/D \leqq 0.60 \quad (2)$$

(where D is the density (g/L) of the returnable container, and F is the flexural modulus (MPa) measured according to ISO 1209).

8) The returnable container for transporting parts according to item 7), wherein a recessed portion serving as a finger insertion portion is provided on an outer surface of a sidewall, and the finger insertion portion and an upper end form a handle structure.

9) The returnable container for transporting parts according to item 8), wherein the finger insertion portion has a shape in which the upper part of the finger insertion portion is concave with respect to the upper end side.

10) The returnable container for transporting parts according to item 9), wherein the thickness between the upper surface of the finger insertion portion and the upper end is 30 to 50 mm, and the length from the upper end to the finger insertion portion is 65 to 90 mm.

11) The returnable container for transporting parts according to item 7), wherein a finger insertion through-hole is provided on a sidewall, and the peripheral surface of the finger insertion through-hole is reinforced with a reinforcing member.

12) The returnable container for transporting parts according to item 11), wherein the reinforcing member reinforcing the peripheral surface of the finger insertion through-hole is composed of a non-expanded resin or an expanded resin with a density of 120 g/L or more.

13) The returnable container for transporting parts according to item 11), wherein the upper end of the opening of the finger insertion through-hole is located at a distance of 30 to 50 mm from the upper end of the sidewall, and the lower end of the opening of the finger insertion through-hole is located at a distance of 60 to 80 mm from the upper end of the sidewall.

The returnable container formed by expansion molding of expanded particles of a polyolefin-based resin is lightweight and has excellent strength. Consequently, when parts constituting a product are placed in the returnable container in a product assembly plant, and the returnable container is transported by a worker within the plant, the returnable container can be transported with as many parts as possible being placed therein, thus being efficient. Furthermore, the returnable container formed by expansion molding of expanded particles of a polyolefin-based resin not only has excellent strength, but also is a material that easily absorbs impacts. Consequently, the returnable container is suitable for transporting parts sensitive to impacts or parts having complex shapes. Furthermore, in comparison with existing containers formed by injection molding, the risk of worker accidents, for example, due to fingers being pinched, can be reduced, which is advantageous.

DETAILED DESCRIPTION OF PREFERRED EMBODIMENTS

Figure 1:
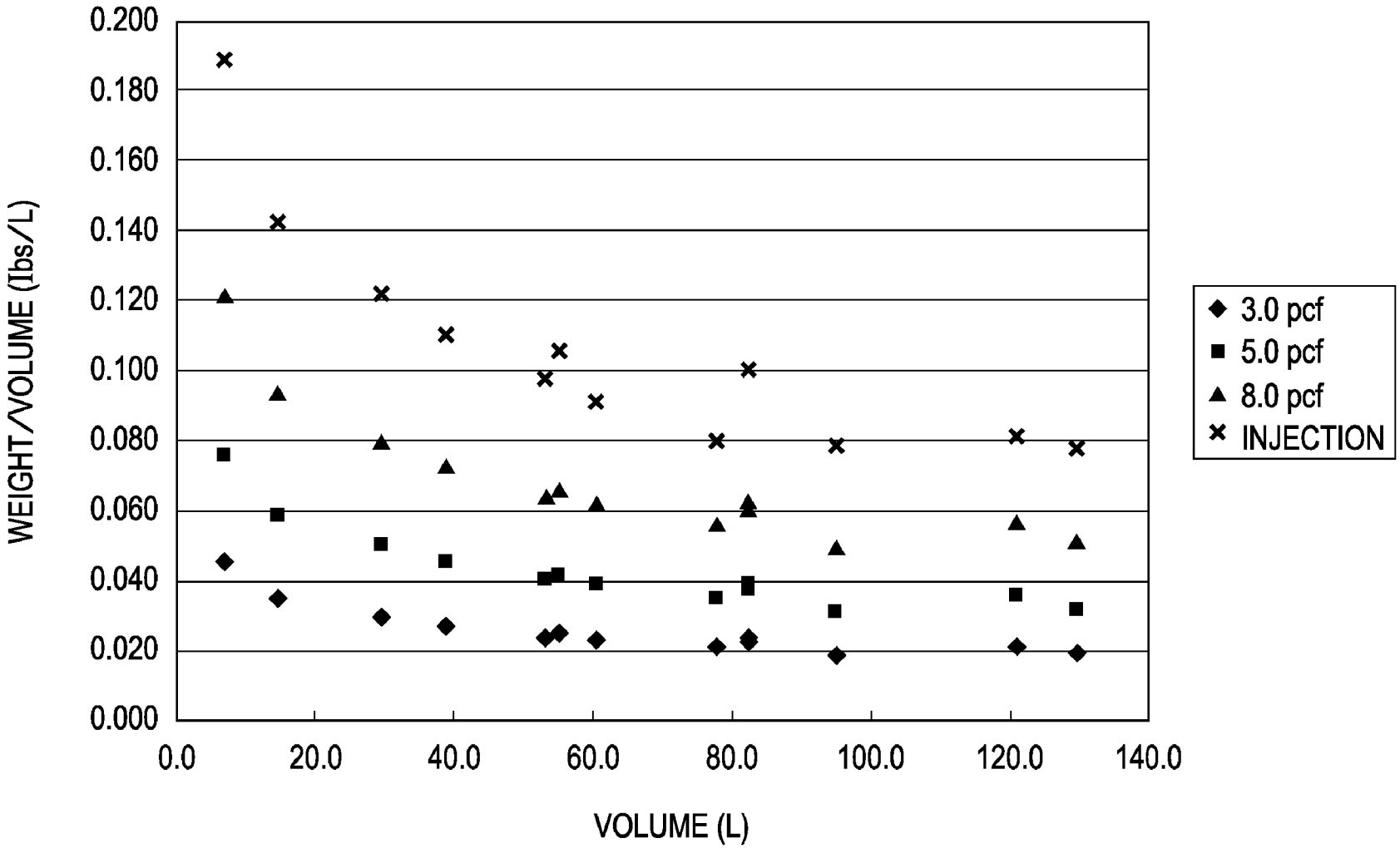
FIG. 1 is a graph in which the relationship between the ratio of weight to volume and volume of returnable containers is plotted.

The present invention provides a method of transporting parts constituting a product in a product assembly plant, in which the parts are placed in a returnable container, and the returnable container is transported by a worker from one location inside or outside the plant to another location inside the plant. The present invention is characterized in that as the returnable container used when the parts are transported by a worker (person) in the assembly plant, a returnable container formed by expansion molding of expanded particles of a polyolefin-based resin is selected, wherein the relationship between the weight and volume of the returnable container satisfies Formula (1) below, and the relationship between the flexural modulus and density of the returnable container satisfies Formula (2) below:

$$650 \leqq (a-W)/W \times V \leqq 4{,}000 \quad (1)$$

(where W is the weight (kg) of the returnable container, V is the volume (L) of the returnable container, and a represents 23 kg, i.e., the maximum weight that can be carried by a worker within the plant, which is recommended by the National Institute for Occupational Safety & Health (NIOSH));

$$0.10 \leqq F/D \leqq 0.60 \quad (2)$$

(where D is the density (g/L) of the returnable container, and F is the flexural modulus (MPa) measured according to ISO 1209).

As returnable containers used in product assembly plants, such as automobile assembly plants or electrical appliance assembly plants, as in the case described above, containers formed by injection molding or press molding of a polyolefin resin are conventionally used. This is because sufficient strength is required for carrying parts. Since the returnable containers themselves are heavy, the contents of the returnable containers actually carried by workers in plants have a significantly smaller volume than the returnable containers. The reason for this is that from the standpoint of preventing workers from suffering lower back pain and injuries, there is a limitation in the maximum weight of a load that can be carried by a worker. The National Institute for Occupational Safety & Health (NIOSH) recommends the maximum weight to be 51 pounds (23 kg) or less (refer to NIOSH Publication No. 94-110—Applications Manual for the Revised NIOSH Lifting Equation). This item is used as a guideline for preventing lower back pain and injuries when workers engaged in carrying loads do tasks which may cause the risk of lower back pain or the like.

On the other hand, containers formed by expansion molding of expanded particles of a polyolefin-based resin, such as polyethylene or polypropylene, are known, but are not used in the manner described above. The reason for this is that the containers formed by expansion molding of expanded particles of a polyolefin-based resin are considered to be unsuitable for use as returnable containers for transporting parts by workers in assembly plants.

The present inventors have conducted research on expansion-molded articles formed using expanded particles of a polyolefin-based resin. Under the assumption that, by taking advantage of the fact that such expansion-molded articles have sufficient strength-to-weight ratio, if the expansion-molded articles are used as returnable containers for transporting parts by workers in assembly plants, which have been inefficient to date, transportation can be performed efficiently, returnable containers have been actually formed and transportation has been performed. As a result, it has been found that such returnable containers have strength equal to that of existing returnable containers, reduction in weight can be achieved, and therefore, efficiency of transportation by workers can be greatly improved. Such use of returnable containers formed by expansion molding of expanded particles of a polyolefin-based resin is very significant from the standpoint of ensuring efficiency of transportation of parts and safety of workers.

In Formula (1), $(a-W)/W\times V$ is the value obtained by multiplying the quotient, which is obtained by dividing the upper weight limit of parts to be contained in a returnable container by the weight of the returnable container, by the volume that can be contained in the returnable container, when the maximum weight a recommended by NIOSH is 23 kg. As this value increases, the container weight decreases under the same container volume, and the container volume increases under the same container weight, thus increasing the number of parts that can be contained in the container. The lower limit 650 is set as a value significantly different from that of a conventionally used returnable container, and is a value that cannot be achieved by existing returnable containers. The upper limit 4,000 is in a range in which a practically usable returnable container can be designed. Therefore, these values characterize the returnable container, which is formed by expansion molding of expanded particles of a polyolefin-based resin, used in the present invention. If the lower limit is 650 or more, the container weight can be decreased or the container volume can be increased, thus increasing the capacity. If the upper limit is 4,000 or less, a returnable container having excellent strength can be obtained. Preferably, the lower limit is 1,000, and the upper limit is 3,500.

FIG. 1 is a graph in which the relationship between the ratio of weight to volume and volume is plotted with respect to returnable containers formed by injection molding which are conventionally used and returnable containers formed by expansion molding of expanded particles of a polyolefin-based resin according to the present invention. As the polyolefin-based resin, a polypropylene resin is used. As is evident from the graph, when the returnable containers formed by expansion molding of expanded particles of the polyolefin-based resin are used, the volume can be increased under the same weight.

Meanwhile, such returnable containers cannot be used simply because they are light and have a large capacity. The returnable containers are required to have toughness to endure impacts and bumps during transportation, rigidity sufficient for receiving parts, and cushioning capacity to protect parts from impacts. Therefore, in the present invention, the relationship between the density and flexural modulus of the returnable container is specified.

In Formula (2), D is the density (g/L) of the returnable container, and F is the flexural modulus (MPa) measured according to ISO 1209. A method for determining F is described in ISO 1209. In the method, a sample with a size of 350×60×15 mm is cut out, and measurement is performed at 23±0.2° C. and 50±5 RH %, under the following conditions: distance between supporting points 300 mm, skinless sample, and deformation rate 20±1 mm/min.

The F/D value is an index showing the balance between the toughness and rigidity of an expansion-molded article. In the expansion-molded article, in general, as the density D decreases, i.e., as the expansion ratio increases, the flexural modulus F decreases. Therefore, by dividing F by D, the influence of the density is eliminated as much as possible. The F/D value reflects characteristics of the base resin and structural characteristics of the expansion-molded article, such as melt adhesion between expanded particles. In general, as the F/D value increases, rigidity increases, but brittleness increases, i.e., toughness decreases, in some cases, resulting in being unable to endure repeated use. Furthermore, in the case of a polyolefin-based resin, melt adhesion between particles may become difficult. As the F/D value decreases, toughness improves, but in some cases, the rigidity of the returnable container may become insufficient. The lower limit is 0.10, and the upper limit is 0.60. If the value is in a range of 0.10 to 0.60, the returnable container has strength that can endure the load of the parts contained therein, and can have durability against breakage, etc. during transportation. Preferably, the lower limit is 0.20, and the upper limit is 0.50.

Figure 2:
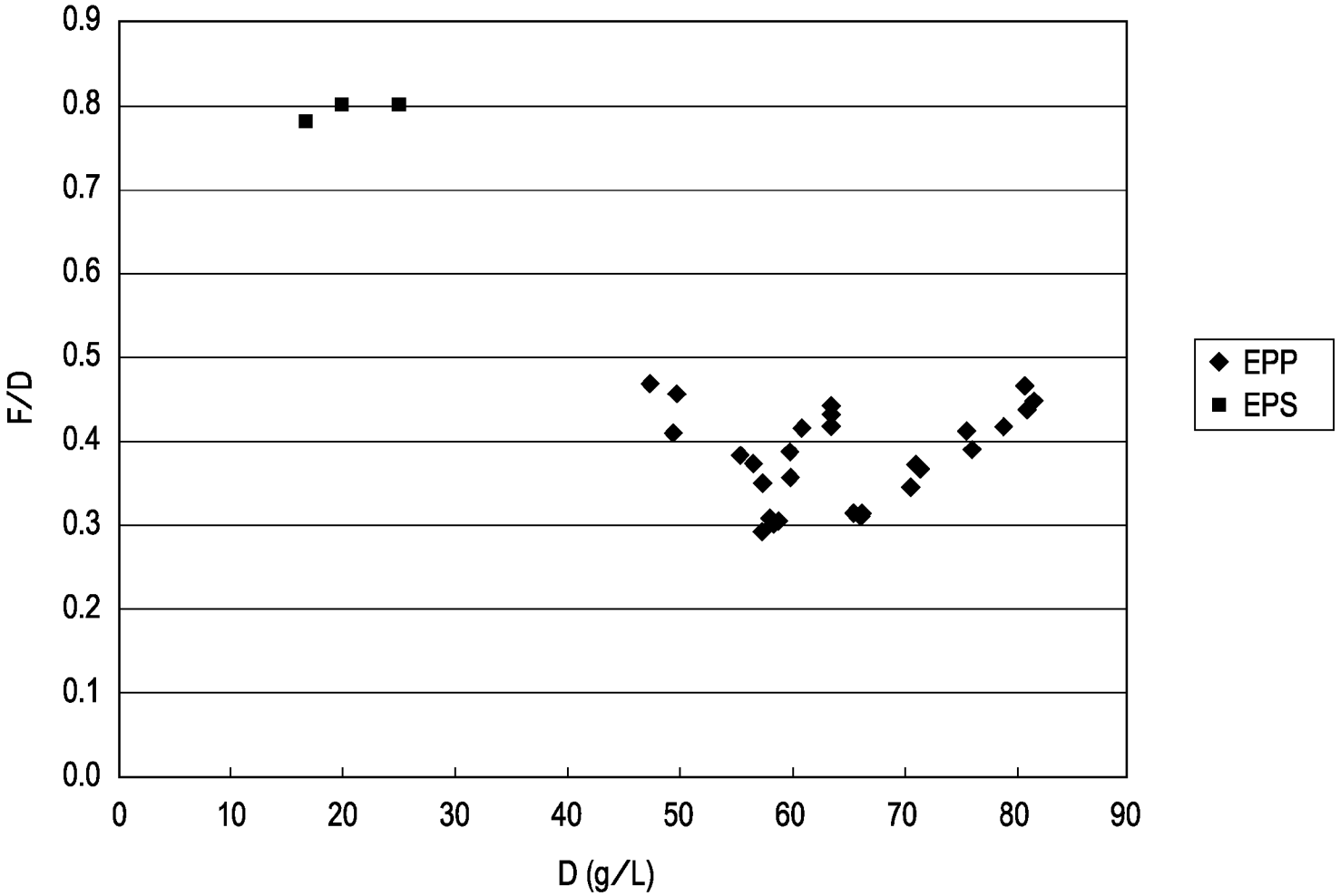
FIG. 2 is a graph in which the relationship between the ratio of flexural modulus to density and density of returnable containers is plotted.
Figure 3:
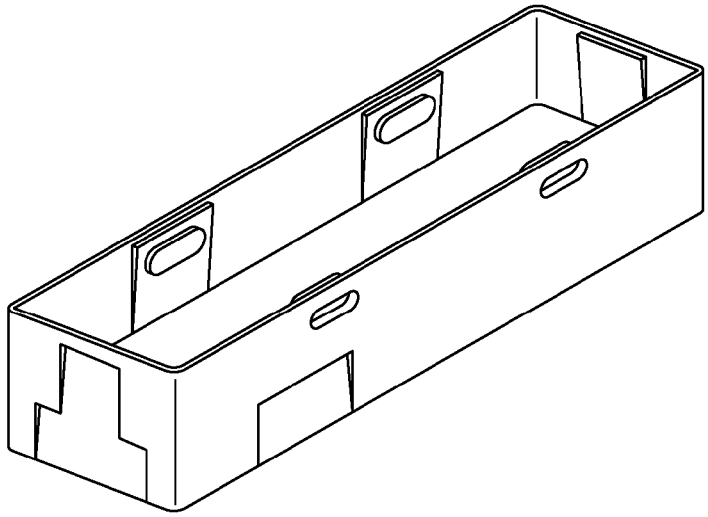
FIG. 3 is an overall view of a returnable container of Example 2.
Figure 4:
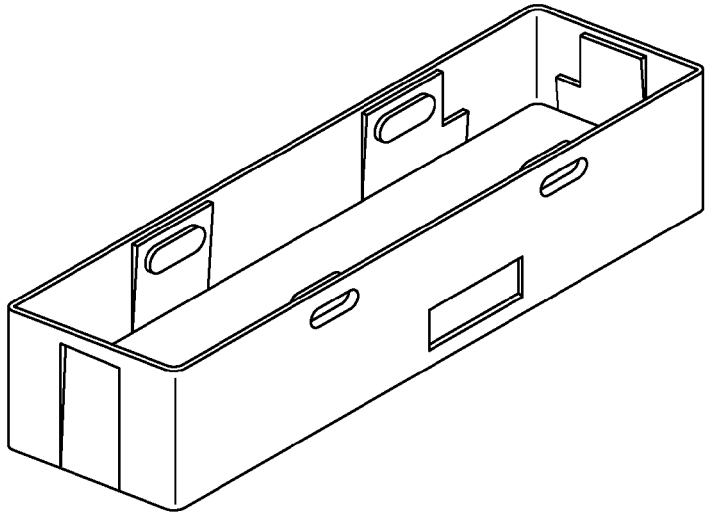
FIG. 4 is an overall view of the returnable container of Example 2.
Figure 5:
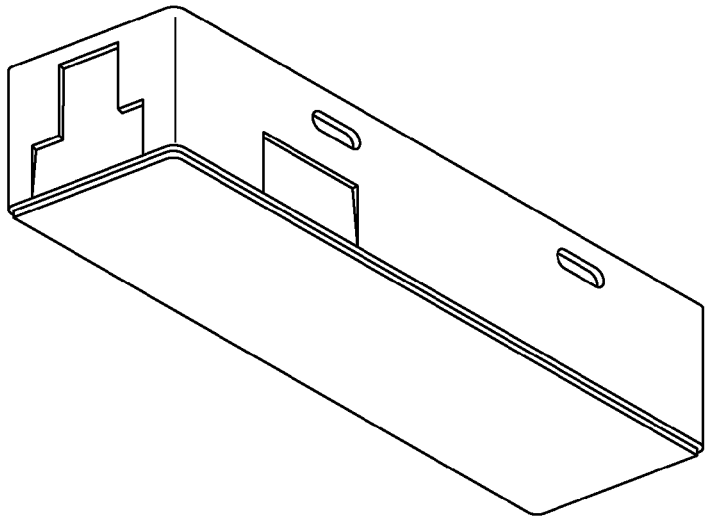
FIG. 5 is an overall view of the returnable container of Example 2.
Figure 6:
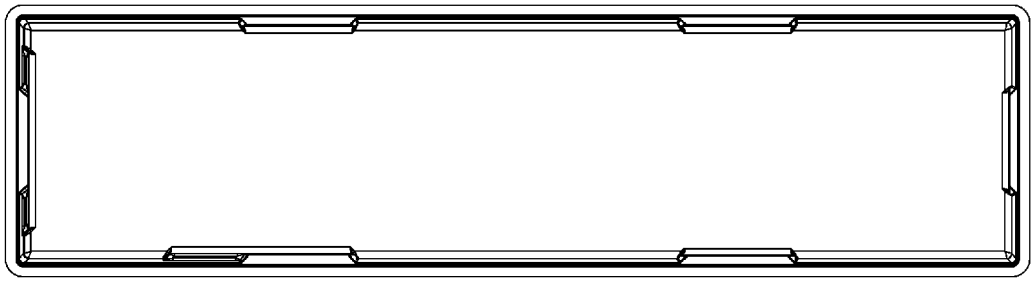
FIG. 6 is a top view of the returnable container of Example 2.
Figure 7:
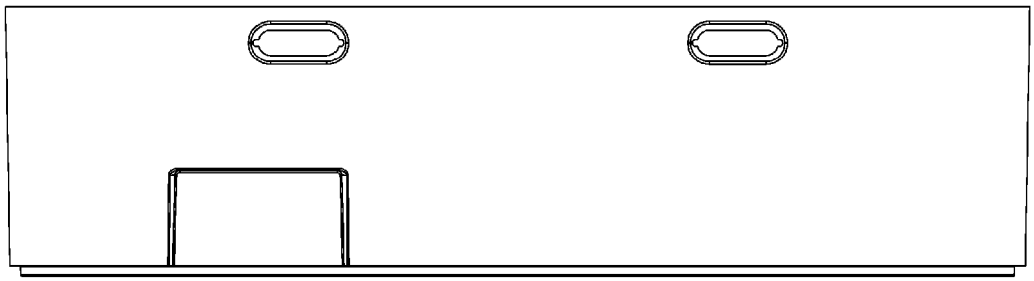
FIG. 7 is a side view of the returnable container of Example 2.
Figure 8:
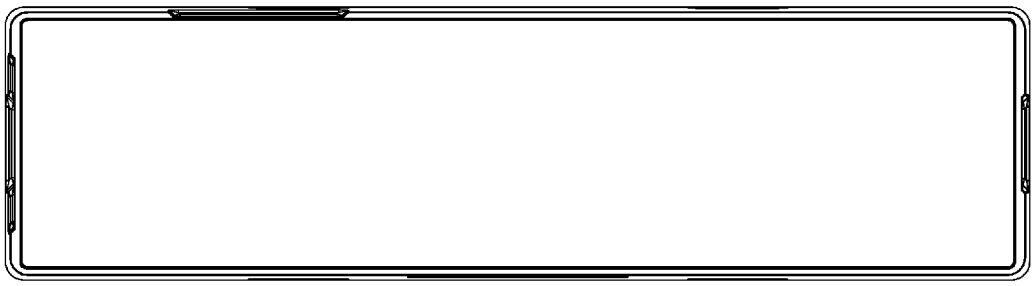
FIG. 8 is a bottom view of the returnable container of Example 2.
Figure 11:
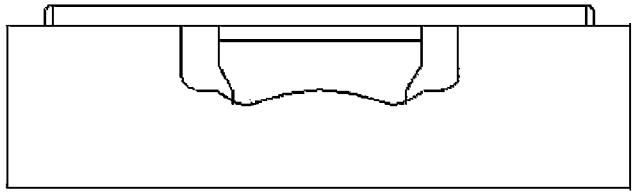
FIG. 11 is another side view of the returnable container of Example 3.
Figure 12:
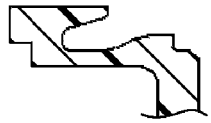
FIG. 12 is a sectional view of a handle structure of the returnable container of Example 3.
Figure 9:
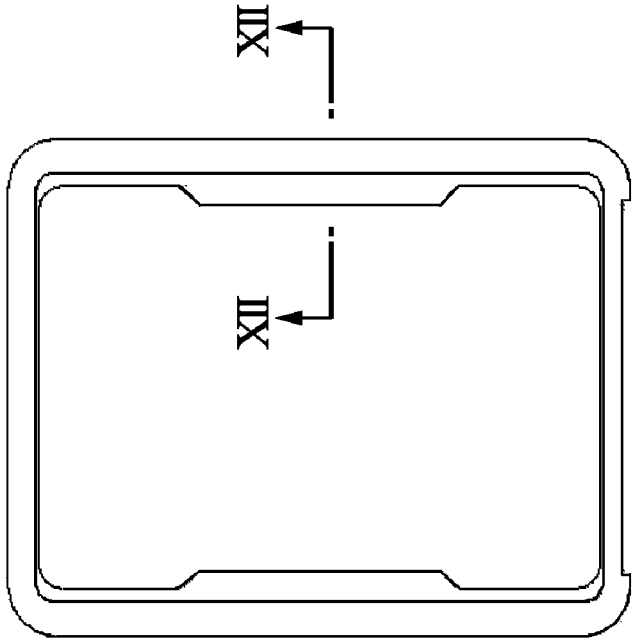
FIG. 9 is a top view of a returnable container of Example 3.
Figure 10:
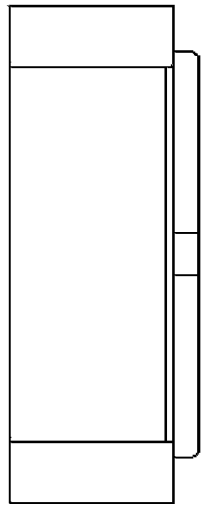
FIG. 10 is a side view of the returnable container of Example 3.
Figure 15:
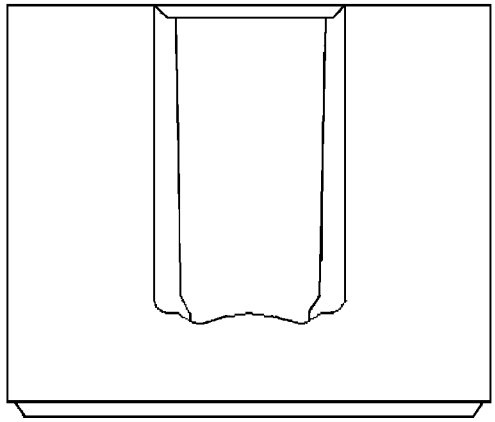
FIG. 15 is another side view of the returnable container of each of Examples 4 and 5.
Figure 16:
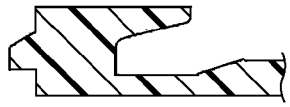
FIG. 16 is a sectional view of a handle structure of the returnable container of each of Examples 4 and 5.
Figure 13:
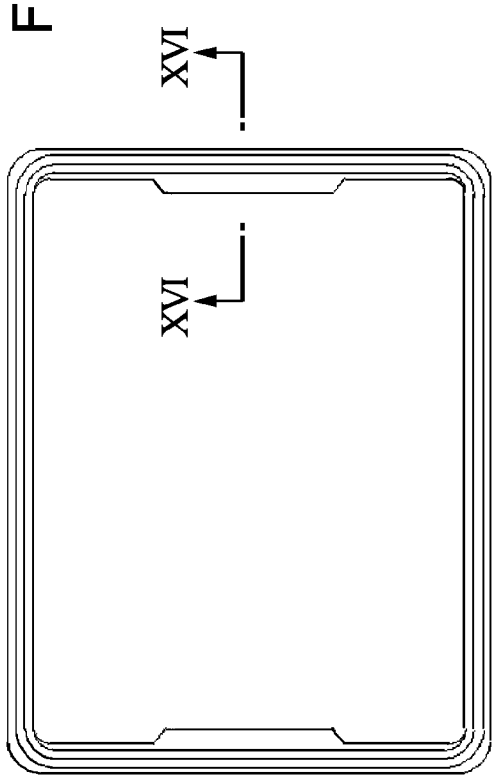
FIG. 13 is a top view of a returnable container of each of Examples 4 and 5.
Figure 14:
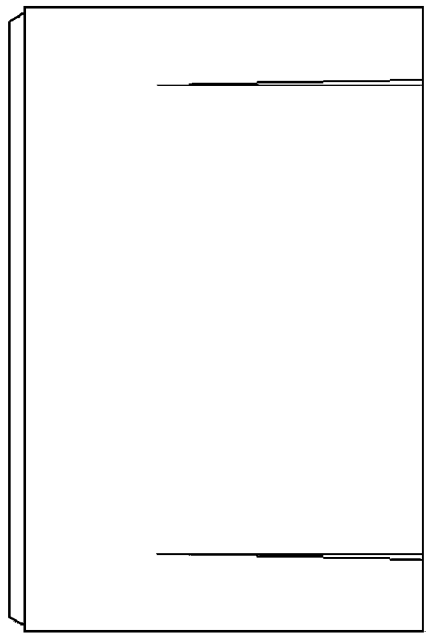
FIG. 14 is a side view of the returnable container of each of Examples 4 and 5.

FIG. 2 is a graph in which the relationship between the ratio of flexural modulus to density and density with respect to returnable containers composed of expanded polystyrene and returnable containers formed by expansion molding of expanded particles of a polyolefin-based resin according to the present invention. As the polyolefin-based resin, a polypropylene resin is used. The expanded polystyrene returnable containers have higher F/D values, but are easily broken by impacts during transportation. The returnable containers composed of the polyolefin-based resin are more suitable for practical use as returnable containers for transporting parts repeatedly used in plants.

Use of returnable containers formed by expansion molding of expanded particles of a polyolefin-based resin has another advantage in that since the returnable containers themselves have cushioning capacity, parts contained therein can be protected from impacts without providing bumper elements, unlike U.S. Pat. No. 3,508,679. Furthermore, since the shape to be molded can be designed with high freedom, as necessary, in order to fix the parts to be transported so as to avoid contact between the parts, ribs, slits, protrusions, and the like can be easily provided inside the returnable containers. Therefore, the returnable containers are suitable for containing parts the surfaces of which must be kept clean and beautiful, for example, subassemblies, such as speed meters and CD drives, before being assembled into finished products, rear-view mirror covers, instrument panel components, and housings for home appliances. Furthermore, when returnable containers are stacked or placed in order, in some cases, the workers' fingers may be pinched. However, since the returnable containers themselves have cushioning capacity, the risk of injuries of the workers can be reduced. From such a standpoint, the preferred lower limit of the density of the returnable container is 35 g/L, and the preferred upper limit is 100 g/L. At a density of 35 g/L or more, a cushioning effect can be achieved while maintaining the strength as the returnable container. At a density of 100 g/L or less, a sufficient cushioning effect can be achieved. More preferably, the lower limit is 40 g/L, and the upper limit is 80 g/L.

In the present invention, use of returnable containers formed by expansion molding of expanded particles of a polyolefin-based resin has the greatest advantage in that molding can be performed in various sizes, and the density can be adjusted. This is an advantage that cannot be expected from injection-molded articles or press-molded articles. The characteristics required in returnable containers in which parts are placed by workers in assembly plants as described above can be freely adjusted, which is greatly advantageous. Furthermore, associated properties, such as durability and recyclability, are also characteristic. Consequently, in particular, in plants where large parts are transported, such as in automobile assembly plants, larger and lighter returnable containers can be used, and transportation efficiency can be improved. From this standpoint, the dimensions of the returnable container can be set at 305 to 1,422 mm (12 to 56 inches) in length, 279 to 572 mm (11 to 22 inches) in width, and 101 to 368 mm (4 to 14 inches) in height.

Furthermore, the thickness of the returnable container is preferably 50 mm or less from the standpoint that structural strength sufficient for the returnable container can be achieved, and sufficient capacity for storing parts can be ensured.

Furthermore, in the present invention, the size of the returnable container to be used can be set as desired as described above, and a desired shape can be obtained as long as an appropriate mold for molding is selected. Therefore, parts to be contained can be positioned in advance, and then arrangement can be performed. Consequently, a plurality of parts can be arranged at predetermined positions, and then transportation can be performed.

The characteristics of the returnable container used in the present invention have been described above. Next, the method in which the returnable container is formed by molding, and the method of adjusting the density and the flexural modulus will be described with reference to specific examples.

Specific examples of the polyolefin-based resin used for the returnable container of the present invention include polypropylene-based resins, such as ethylene-propylene random copolymers, 1-butene-propylene random copolymers, ethylene-1-butene-propylene random terpolymers, ethylene-propylene block copolymers, and homopolypropylene; polyethylene-based resins, such as low-density polyethylene, medium-density polyethylene, high-density polyethylene, linear low-density polyethylene, and ethylene-vinyl acetate copolymers; polybutene; and polypentene.

Among these, a polypropylene-based resin is preferred, and the polypropylene-based resin preferably contains ethylene and/or 1-butene as a comonomer. If the polypropylene-based resin contains ethylene and/or 1-butene, expanded particles and in-mold expansion-molded articles can be easily obtained. The ethylene content is preferably 0.5% to 4.0%, and more preferably 1.0% to 3.0%. The 1-butene content is preferably 2.5% to 5.5%, and more preferably 3.0% to 4.5%. Note that the comonomer content on the basis of ethylene or 1-butene in the polypropylene-based resin can be determined using 13C-NMR.

The polypropylene-based resin used in the present invention preferably contains, as a monomer, 80% by weight or more of propylene, and may contain a comonomer other than ethylene. Examples of the other comonomer include α-olefins having 4 to 12 carbon atoms, such as 1-butene, isobutene, 1-pentene, 3-methyl-1-butene, 1-hexene, 4-methyl-1-pentene, 3,4-dimethyl-1-butene, 1-heptene, 3-methyl-1-hexene, 1-octene, and 1-decene; cyclic olefins, such as cyclopentene, norbornene, and tetracyclo[6,2,11,8,13,6]-4-dodecene; dienes, such as 5-methylene-2-norbornene, 5-ethylidene-2-norbornene, 1,4-hexadiene, methyl-1,4-hexadiene, and 7-methyl-1,6-octadiene; and vinyl monomers, such as vinyl chloride, vinylidene chloride, acrylonitrile, vinyl acetate, acrylic acid, methacrylic acid, maleic acid, ethyl acrylate, butyl acrylate, methyl methacrylate, maleic anhydride, styrene, methyl styrene, vinyltoluene, and divinylbenzene. These may be used alone or in combination.

The polypropylene-based resin used in the present invention may be a random copolymer or a block copolymer. In particular, an ethylene-propylene random copolymer, a propylene-1-butene random copolymer, or an ethylene-propylene-1-butene random terpolymer, which is versatile, is preferably used.

It is also preferable to use PIOCELAN (trademark) or ARCEL (trademark) including base resins composed of polystyrene and polyethylene.

Specific expanded particles and a method of producing a molded article from the expanded particles will be described on the basis of a production example in which a polypropylene-based resin is used.

The melting point of the polypropylene-based resin used in the present invention is preferably 135° C. to 155° C., and more preferably 140° C. to 150° C.

The melting point is determined by the method described below. Using a differential scanning calorimeter (DSC), 5 to 6 mg of a sample of polypropylene-based resin particles is heated from 40° C. to 220° C., at a heating rate of 10° C./min, to melt the resin. Then, crystallization is performed by decreasing the temperature from 220° C. to 40° C. at 10° C./min. After the crystallization, heating is performed from 40° C. to 220° C. at 10° C./min. In the DSC curve obtained in the second heating process, the fusion peak temperature is defined as the melting point.

As the melting point increases, the rigidity of the polyolefin-based resin used as the base resin increases, and the F/D value of the expansion-molded article tends to increase, but toughness decreases. In addition, it becomes difficult to ensure melt adhesion between expanded particles, and breakage easily occurs. If the melting point is too low, rigidity decreases, and in some cases, the F/D value may not be sufficient.

The melt flow rate (MFR) is measured, according to ASTM D1238, at 230° C. at a load of 2.16 kg. In order to obtain good expandability and moldability, the MFR is in a range of preferably 1 to 20 g/10 min, and more preferably 3 to 15 g/10 min. At a high MFR, molecular orientation easily occurs because the average molecular weight is low, and rigidity tends to increase, but toughness decreases. At an excessively high MFR, since the melt viscosity decreases, foam breakage easily occurs during the formation of expanded particles or during molding, and as a result, in some cases, the F/D value may not be sufficient. On the other hand, at an excessively low MFR, expandability decreases, it becomes difficult to ensure melt adhesion between expanded particles, and in some cases, the F/D value may not be sufficient.

In order to facilitate the formation of expanded particles, preferably, the polyolefin-based resin is usually melted using an extruder, a kneader, a Banbury mixer, a roller, or the like, and formed into resin particles in the shape of cylinders, ellipsoids, spheres, cubes, rectangular parallelepipeds, or the like. With respect to the size of the resin particles, the weight per particle is preferably 0.1 to 30 mg, and more preferably 0.3 to 10 mg. The weight per resin particle corresponds to an average resin particle weight of random 100 resin particles, and is expressed in mg/particle. When an additive is added to the resin, preferably, the additive is mixed with the raw material resin using a blender or the like before the formation of the polypropylene-based resin particles. Alternatively, the additive may be added to a molten resin.

The polyolefin-based resin particles can be formed into expanded particles of the polyolefin-based resin using a known method. For example, the following method may be used. First, polyolefin-based resin particles are dispersed in a dispersing medium in a pressure-resistant container, and a foaming agent is added thereto. Then, heating is performed at the softening temperature of the polyolefin-based resin particles or higher, preferably in a temperature range from the melting point of the polyolefin-based resin particles minus 25° C. to the melting point of the polyolefin-based resin particles plus 25° C., more preferably in a temperature range from the melting point of the polyolefin-based resin particles minus 15° C. to the melting point of the polyolefin-based resin particles plus 15° C., followed by application of pressure, so that the polyolefin-based particles are impregnated with the foaming agent. Then, one end of the pressure-resistant container is opened to discharge the polyolefin-based resin particles into the atmosphere having a lower pressure than that in the pressure-resistant container, and thereby, expanded particles of the polyolefin-based resin are produced.

The pressure-resistant container in which the polyolefin-based resin particles are dispersed is not particularly limited as long as the container can resist the pressure and temperature during the production of the expanded particles therein. For example, an autoclave-type pressure-resistant container may be used.

As the dispersing medium, methanol, ethanol, ethylene glycol, glycerol, water, or the like can be used. In particular, use of water is preferable.

In order to prevent aggregation of polyolefin-based particles in the dispersing medium, a dispersant is preferably used. Examples of the dispersant include inorganic dispersants, such as tricalcium phosphate, trimagnesium phosphate, basic magnesium carbonate, calcium carbonate, barium sulfate, kaolin, talc, and clay.

Furthermore, preferably, an auxiliary dispersion agent is used together with the dispersant. Examples of the auxiliary dispersion agent include anionic surfactants, such as carboxylate-type anionic surfactants (e.g., N-acylamino acid salts, alkyl ether carboxylates, and acylated peptides); sulfonate-type anionic surfactants (e.g., alkyl sulfonates, alkyl benzene sulfonates, alkyl naphthalene sulfonates, and sulfosuccinates); sulfate-type anionic surfactants (e.g., sulfate oil, alkyl sulfates, alkyl ether sulfates, and alkylamide sulfates); and phosphate-type anionic surfactants (e.g., alkyl phosphates, polyoxyethylene phosphates, and alkyl allyl ether phosphates). Furthermore, polycarboxylate-type polymer surfactants, such as maleic acid copolymer salts and polyacrylic acid salts; and polyanionic polymer surfactants, such as polystyrene sulfonates and naphthalsulfonic acid-formalin condensate salts, can also be used.

As the auxiliary dispersion agent, preferably, a sulfonate-type anionic surfactant is used, and more preferably, one or a mixture of two or more selected from the group consisting of alkyl sulfonates and alkyl benzene sulfonates is used.

Among them, preferably, as the dispersant, tricalcium phosphate, trimagnesium phosphate, barium sulfate, or kaolin is used together with sodium n-paraffin sulfonate or sodium alkyl benzene sulfonate as the auxiliary dispersion agent.

The amounts of the dispersant and the auxiliary dispersion agent to be used vary depending on the types thereof and the type and amount of the polyolefin-based resin to be used. Usually, preferably, the dispersant is added in an amount of 0.2 to 3 parts by weight, and the auxiliary dispersion agent is added in an amount of 0.001 to 0.1 parts by weight on the basis of 100 parts by weight of the dispersing medium. It is usually preferable to use the polypropylene-based resin particles in an amount of 20 to 100 parts by weight on the basis of 100 parts by weight of the dispersing medium in order to attain good dispersibility in the dispersing medium.

In the production of the expanded particles of the polyolefin-based resin, any foaming agent may be used without particular limitations. Examples of the foaming agent include aliphatic hydrocarbons, such as propane, isobutane, normal butane, isopentane, and normal pentane; inorganic gases, such as air, nitrogen, and carbon dioxide; water; and mixtures of these. Among them, isobutene is preferable in order to obtain expanded particles having a high expansion ratio, and carbon dioxide is preferable in order to obtain expanded particles having a low expansion ratio. When water is used as the foaming agent, the water to be used as the dispersing medium can be used.

A two-shot process may be employed, in which the expanded particles of the polyolefin-based resin are impregnated with an inert gas, such as air, so that an expanding force is applied to the expanded particles, and then further expansion is performed by heating to thereby produce expanded particles of the polyolefin-based resin with a higher expansion ratio. Furthermore, the expanded particles which have been subjected to the two-shot process may be further expanded.

When the expanded particles of the polyolefin-based resin used in the present invention are subjected to differential scanning calorimetry (DSC) (3 to 6 mg of sample, temperature range of 40° C. to 220° C., and heating rate of 10° C./min), preferably, the expanded particles of the polyolefin-based resin have two fusion peaks on the low temperature side and the high temperature side in the DSC curve obtained. If the expanded particles of the polyolefin-based resin have two fusion peaks, the ranges of the molding conditions, such as the heating temperature range, increase when in-mold expansion molding is performed.

The ratio of the high-temperature-side heat of fusion (QH/(QH+QL)×100), which can be calculated from the low-temperature-side heat of fusion QL and the high-temperature-side heat of fusion QH corresponding to the two fusion peaks in the DSC curve, (hereinafter may be referred to as the "DSC ratio"), is preferably in a range of 10% to 40%. Here, the low-temperature-side heat of fusion QL is defined as the quantity of heat corresponding to a region surrounded by a tangent line drawn from the maximum point between the fusion peak on the low temperature side and the fusion peak on the high temperature side to the base line in the vicinity of the fusion-start temperature and the fusion peak on the low temperature side. The high-temperature-side heat of fusion QH is defined as the quantity of heat corresponding to a region surrounded by a tangent line drawn from the maximum point to the base line in the vicinity of the fusion-end temperature and the fusion peak on the high temperature side.

If the DSC ratio is less than 10%, the closed-cell ratio of the expanded particles of the polyolefin-based resin is low, and the shrinkage ratio of the in-mold expansion-molded article tends to increase. If the DSC ratio exceeds 40%, in some cases, it may not be possible to obtain a sufficient secondary expanding force when the expanded particles of the polyolefin-based resin are subjected to in-mold expansion molding, and melt adhesion between particles may be poor in the resulting in-mold expansion-molded article.

The polyolefin-based resin and the aqueous dispersing medium are placed in the pressure-resistant container, and impregnation of the foaming agent is performed at a given temperature and a given pressure. Then, the mixture is discharged from the pressurized container into the low-pressure atmosphere through one or a plurality of openings with a diameter of 1 to 10 mm, and the impregnated foaming agent is vaporized so that the polyolefin-based resin is expanded to thereby obtain expanded particles.

The expanded particles of the polyolefin-based resin used in the present invention have a bulk density of 15 to 100 g/L, preferably about 20 to 90 g/L, and an expansion ratio of 5 to 30, preferably about 6 to 20.

When the expanded particles of the polyolefin-based resin of the present invention are used in in-mold expansion molding, any of known methods may be used, for example, a) a method in which the expanded particles are directly used; b) a method in which the expanded particles are imparted with expandability by injection of an inorganic gas, such as air, into the expanded particles in advance; c) the expanded particles in a pressurized state are filled into a mold, and then molding is performed.

In one example of producing an expansion-molded article from the expanded particles of the polyolefin-based resin of the present invention, the expanded particles of the polyolefin-based resin are filled in a mold which can be closed but cannot be hermetically sealed, and molding is performed, using water vapor or the like as a heating medium, at a heating water vapor pressure of about 0.05 to 0.5 MPa for about 3 to 30 seconds to cause melt adhesion between the expanded particles of the polyolefin-based resin. Then, the mold is cooled with water to the extent that the in-mold expansion-molded article taken out of the mold can be prevented from deforming, and the mold is opened to obtain the in-mold expansion-molded article.

The specific example of the method of producing the returnable container has been described above. From the standpoint of protection of parts and safety of workers, a major advantage of the present invention is that the density and flexural modulus of the returnable container can be controlled. Although the method for controlling the density and flexural modulus depends on the resin to be used or molding conditions, generally, the desired density and flexural modulus may be obtained on the basis of the following guidelines.

1) As the content of the polypropylene resin in the resin material to be used is increased, the density tends to decrease; and as the content of the ethylene resin is increased, the density tends to increase.

2) When compared under the same resin, as the impregnation amount or foaming temperature of the foaming agent is increased, the density tends to decrease.

3) When the density of the returnable container is increased and a polypropylene resin is selected as the resin, the flexural modulus tends to increase.

4) If the water vapor pressure is increased, the flexural modulus tends to increase.

Figure 17:
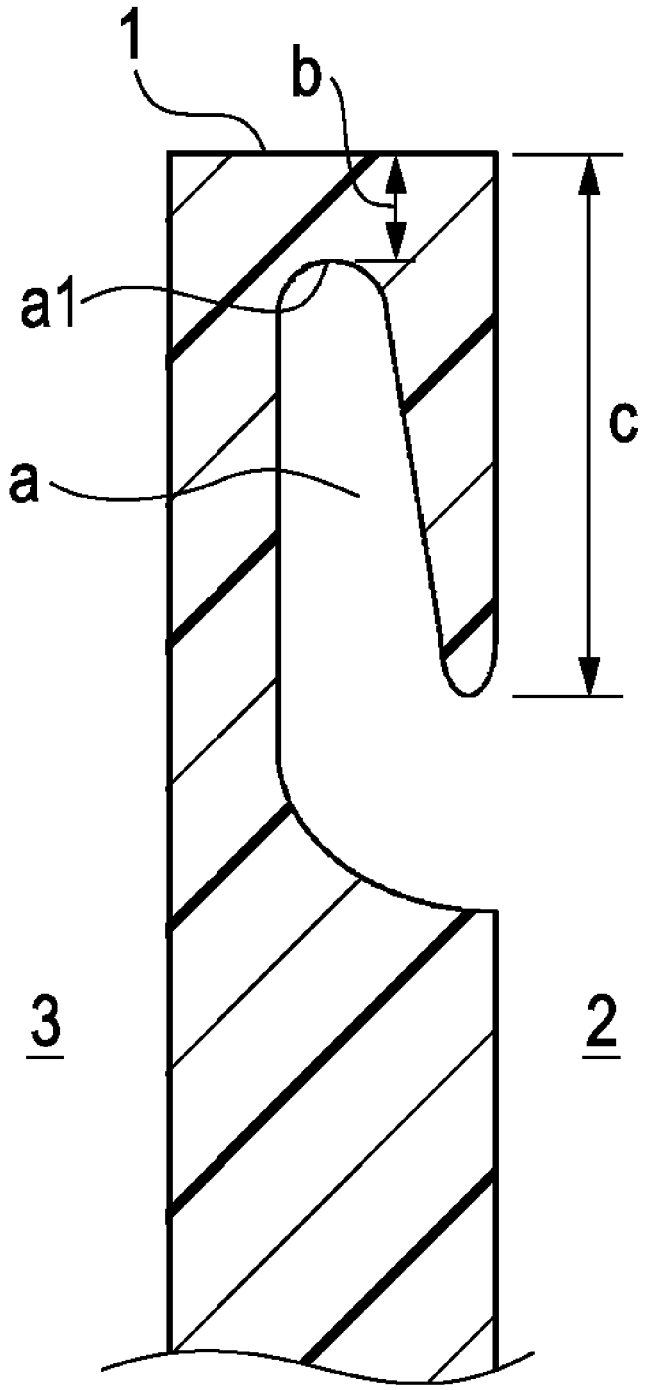
FIG. 17 is a sectional view showing an example of a handle structure according to the present invention.

The returnable container produced as described above may have the shape, for example, as shown in FIGS. 3 to 8, FIGS. 9 to 11, or FIGS. 13 to 16. In order to facilitate carrying by a worker, the returnable container of the present invention may have the structure as shown in FIG. 17, in which a recessed portion a serving as a finger insertion portion is provided on a surface of the sidewall on the outer side 2, and the finger insertion portion a and an upper end 1 form a handle structure. Reference numeral 3 represents the inner wall side of the container. From the standpoint of ease of handling by the worker, preferably, the finger insertion portion a has a shape in which the upper part of the finger insertion portion a is concave with respect to the upper end 1 side. Preferably, the thickness b between the upper surface al of the finger insertion portion and the upper end 1 is 30 to 50 mm, and the length c from the upper end 1 to the finger insertion portion is 65 to 90 mm.

Alternatively, the returnable container may have a finger insertion through-hole provided on the sidewall thereof, and the peripheral surface of the finger insertion through-hole may be reinforced with a reinforcing member. Preferably, the reinforcing member reinforcing the peripheral surface of the finger insertion through-hole is composed of a non-expanded resin or an expanded resin with a density of 120 g/L or more. Examples of such a non-expanded resin include polypropylene, polyethylene, nylon, polyvinyl chloride, and polystyrene. The expanded resin is preferably polypropylene or polyethylene, and the density can be adjusted by the method as that specifically described above in the method of producing the returnable container formed by expansion-molding of expanded particles of the polypropylene-based resin. Preferably, the upper end of the opening of the finger insertion through-hole is located at a distance of 30 to 50 mm from the upper end of the sidewall, and the lower end of the opening of the finger insertion through-hole is located at a distance of 60 to 80 mm from the upper end of the sidewall.

By forming the finger insertion portions or the through-holes as described above, carrying is greatly facilitated. Consequently, returnable containers can be molded into a shape that is suitable as the returnable containers carried by workers in plants. This is another advantage of the present invention which employs a returnable container formed by expansion molding of expanded particles of the polyolefin-based resin. That is, in the case of returnable containers formed by injection molding or press molding which are conventionally used, it is not possible to form finger insertion portions or through-holes due to limitations of the molding method, and the returnable containers are usually carried using the rib structure which is provided on the outer surface thereof and into which fingers are hooked.

In contrast, if the polyolefin-based resin expansion-molded article is used, finger insertion portions can be formed in the molding process, which is advantageous. Even in an undercut structure, such as the finger insertion portion shown in FIG. 4, in the case of the polyolefin-based resin expansion-molded article, when the molded article is taken out of the mold after molding, the molded article can deform and recover because of its flexibility and recovery property, and thus the molded article can be taken out without damage. In order to form through-holes, after fabrication is required. In comparison with the returnable containers formed by injection molding or press molding, through-holes are easily formed by punching or cutout in polyolefin-based resin expansion-molded articles, which is advantageous.

Another embodiment of the present invention relates to a reusable expanded foam tote/bin/box/container, which can include a fixed solid plastic film liner, which works as a lightweight returnable shipping container for industrial, commercial, and agricultural packaging applications.

This embodiment of the present invention is a reusable foam packing tote/bin/box/container, which is comprised of expanded polypropylene foam bead.

These elements are connected/manufactured as follows (1) Through a foam molding process, the foam bead is molded into a tote/box/container.

(2) Thermal plastic molding to produce a tote/bin/box/container.

This tote/bin/box/container will be produced in a variety of sizes. Further, this invention can have one or more of the following: hand-holds molded into the sides of the tote/bin/box/container, mechanisms to enable stacking, shipping, in-molded identification label holders, tote/bin/box/container lids, and tote/bin/box/container pallets. It should be further noted that the tote/bin/box/container can be molded from various materials, such as, but not limited to: foam polyolefin family of plastics, foam resin material, or synthetic resin foam, but polyolefin foam bead is preferred. The tote/bin/box/container may include properties such as: anti-static, static dissipation, and chemical resistance.

An expanded polyolefin tote/bin/box/container that can include a plastic film liner. It works as a lightweight returnable shipping container for industrial, agricultural and commercial applications. It is lightweight, strong, durable, with broad thermal properties (performs well in hot and cold temperatures). The nature of the tote/bin/box/container construction improves safety of those who handle and work with it. It has high chemical resistance. The containers can be molded into a variety of shapes and sizes which can be custom-configured to meet the need of the customer, consumer, or product. The location of hand-holds can be altered. The thickness of the foam can adjusted.

While the specific immediate application is in automotive manufacturing shipping of parts and supplies, these returnable containers can be molded into a variety of shapes and sizes for various markets (agricultural, commercial, etc), with the major advantage being that the containers are highly durable and extremely light-factors which impact not only shipping costs but ergonomics of manual labor as well.

The another embodiment related to

1) A molded foam box/container which can include an affixed plastic liner.

2) The invention of 1) further comprising hand-holds for carrying.

3) The invention of 1) further comprising a structure for stacking and movement.

4) The invention of 1) includes mechanisms for labeling and identification of contents, for example, but not limited to, adhesive label, card labels, and RFID tags.

5) The invention of 1) comprises mechanisms to accommodate lids and tops.

6) The invention of 1) can include properties such as: anti-static, static, dissipation, and chemical resistance.

The purpose is to provide expanded polyolefin foam packing which is lightweight, durable, reusable, recyclable, and provides thermal insulation and impact protection for returnable shipping applications. Packaging will be used in the supply chain, from manufacturer and/or distributor to the next shop on the distribution chain. While the tote/bin/box/container can be molded into a variety of shapes and sizes, the invention of 1) will be molded to the GMA (Grocery Manufacturer's Association) packing size standards.

Unlike other packaging, this invention can insulate the contents it carries from both temperature extremes and impact, thereby protecting the contents. The lower weight of this invention will often allow the shipment of more parts per container because the packaging does not significantly add to maximum weight restrictions. The expanded polyolefin foam will be molded to provide a thick "skin" which improves the integrity of the structure, durability, and clean-ability of the packaging.

EXAMPLES

Example 1

A mixture obtained by dry blending 500 ppm of talc and 1,500 ppm of calcium stearate into an ethylene-propylene random copolymer with a melting point of 146° C. and a MFR of 8 g/10 min was fed into a 58-mm twin-screw extruder, followed by melting and kneading, and the resulting mixture was extruded into strands through a die plate having a plurality of holes with a diameter of 2.2 mm. The extruded strands were cooled by passing through a water tank, and then cut into cylindrical pellets having a particle weight of 1.2 mg and L/D of 3.2 by a pelletizer. An autoclave-type pressure-resistant container was charged with 100 parts by weight of the pellets, 150 parts by weight of water, 1.4 parts by weight of tricalcium phosphate, 0.035 parts by weight of sodium n-paraffin sulfonate, and isobutane in the amount shown in Table 1. The mixture was heated under stirring and retained at the temperature shown in Table 1. Then, isobutane was injected into the container, and the internal pressure was adjusted to the pressure shown in Table 1. The mixture was maintained in this state for 30 minutes, and then discharged through an orifice plate having three holes with a diameter of 5 mm into the atmospheric pressure environment while maintaining the internal pressure at the pressure described above. Thereby, expanded particles having the bulk density and DSC ratio were obtained for each Reference Example shown in Table 1.

Table 1

The resulting particles were molded by a counter pressure molding process, and thereby, rectangular molded articles of 360 mm×360 mm×50 mm were obtained. That is, the particles were filled in a mold cavity under compressed air, and after the air pressure was decreased, heating was performed with water vapor at 0.32 MPa to cause melt adhesion between the expanded particles. Then, the mold was cooled with water, and an expansion-molded article was taken out and dried at 80° C. for 12 hours or more to thereby obtain the finished molded article. In this process, by controlling the air pressure compressing the expanded particles, the compression ratio, defined by density of molded article/bulk density of expanded particles, was adjusted in a range of 1.3 to 2.0, and molded articles with various densities were prepared.

Each of the resulting molded articles was cut into a sample with a size of 350×60×15 mm. The sample was left to stand in an atmosphere at 23° C. for 24 hours or more, and then the flexural modulus was measured according to ISO 1209. The results are plotted in FIG. 2. As Expanded Poly-Styrene, Kanepearl NSG (manufactured by Kaneka Corporation) was used for comparison.

Example 2

Using the expanded particles of Reference Example 1 shown in Table 1, a returnable container with dimensions of 1,422 mm (56.0 inches) in length, 378 mm (14.9 inches) in width, and 382 mm (15.0 inches) in height was molded by the counter pressure molding process using water vapor at 0.34 MPa, as shown in FIGS. 3 to 8. By adjusting the air pressure during the counter pressure molding, the molded article was formed so as to have a density of 80 g/L (compression ratio of 1.6). Two through-holes were formed in each of the sidewalls extending in the longitudinal direction (four through-holes in total) using a hot cutter, and then reinforcing members composed of non-expanded polypropylene were inserted onto the peripheral surfaces of the through-holes and fixed with screws. Thereby, finger insertion through-holes were formed. In each through-hole, the distance between the upper end of the returnable container and the upper end of the opening was 34 mm, and the distance between the upper end of the returnable container and the lower end of the opening was 78 mm. The width of the through-holes was set at 117 mm.

Example 3

Using the expanded particles of Reference Example 2 shown in Table 1, a returnable container with dimensions of 572 mm (22.5 inches) in length, 457 mm (18 inches) in width, and 368 mm (14.5 inches) in height was molded by the counter pressure molding process using water vapor at 0.34 MPa, as shown in FIGS. 9 to 12. By adjusting the air pressure during the counter pressure molding, the molded article was formed so as to have a density of 60 g/L (compression ratio of 1.7). By incorporating a finger insertion portion structure into the mold, finger insertion portions were formed during the molding. The thickness b between the upper surface al of the finger insertion portion and the upper end 1 of the returnable container was set at 47 mm, and the length c from the upper end 1 to the finger insertion portion was set at 80 mm.

Example 4

Using the expanded particles of Reference Example 2 shown in Table 1, a returnable container with dimensions of 305 mm (12 inches) in length, 381 mm (15 inches) in width, and 102 mm (4 inches) in height was molded by the counter pressure molding process using water vapor at 0.34 MPa, as shown in FIGS. 13 to 16. By adjusting the air pressure during the counter pressure molding, the molded article was formed so as to have a density of 60 g/L (compression ratio of 1.7). By incorporating a finger insertion portion structure into the mold, finger insertion portions were formed during the molding. The thickness b between the upper surface a1 of the finger insertion portion and the upper end 1 of the returnable container was set at 39 mm, and the length c from the upper end 1 to the finger insertion portion was set at 72 mm.

Example 5

Using the expanded particles of Reference Example 3 shown in Table 1, a returnable container with dimensions of 305 mm (12 inches) in length, 381 mm (15 inches) in width, and 102 mm (4 inches) in height was molded by the counter pressure molding process using water vapor at 0.34 MPa, as shown in FIGS. 13 to 16. By adjusting the air pressure during the counter pressure molding, the molded article was formed so as to have a density of 45 g/L (compression ratio of 1.7). By incorporating a finger insertion portion structure into the mold, finger insertion portions were formed during the molding. The thickness b between the upper surface al of the finger insertion portion and the upper end 1 of the returnable container was set at 39 mm, and the length c from the upper end 1 to the finger insertion portion was set at 72 mm.

TABLE 1

| Reference Example | Amount of butane charged | Temperature | Pressure | Bulk density | DSC ratio |
|---|---|---|---|---|---|
| 1 | 4.5 parts | 145.0° C. | 1.36 MPa | 50 g/L | 25 |
| 2 | 6.2 parts | 145.3° C. | 1.47 MPa | 36 g/L | 28 |
| 3 | 6.4 parts | 142.1° C. | 1.74 MPa | 26 g/L | 26 |

What is claimed is:

1. A method of transporting parts constituting a product in a product assembly plant, the method comprising placing the parts in a returnable container, the returnable container being carried by a worker within the plant, wherein the returnable container is formed by expansion molding of expanded particles of a polyolefin-based resin, the relationship between the weight and volume of the returnable container satisfies Formula (1) below, and the relationship between the flexural modulus and density of the returnable container satisfies Formula (2) below:

$$650 \leqq (a-W)/W \times V \leqq 4{,}000 \quad (1)$$

(where W is the weight (kg) of the returnable container, V is the volume (L) of the returnable container, and a represents 23 kg, i.e., the maximum weight that can be carried by a worker within the plant, which is recommended by the National Institute for Occupational Safety & Health (NIOSH));

$$0.10 \leqq F/D \leqq 0.60 \quad (2)$$

(where D is the density (g/L) of the returnable container, and F is the flexural modulus (MPa) measured according to ISO 1209).

2. The method of transporting parts according to claim 1, wherein the parts are transported within an automobile assembly plant or an electrical appliance assembly plant.

3. The method of transporting parts according to claim 1, wherein the polyolefin-based resin is a polypropylene-based resin.

4. The method of transporting parts according to claim 1, wherein the density D of the returnable container is 35 to 100 g/L.

5. The method of transporting parts according to claim 1, wherein the returnable container has dimensions of 305 to 1,422 mm (12 to 52 inches) in length, 279 to 572 mm (11 to 22 inches) in width, and 101 to 368 mm (4 to 14 inches) in height.

6. The method of transporting parts according to claim 1, wherein the maximum thickness of the returnable container is less than 50 mm.

7. A returnable container for transporting parts constituting a product in a product assembly plant, in which the parts are placed in the returnable container, and the returnable container is carried by a person from one location inside or outside the plant to another location inside the plant, wherein the returnable container is formed by expansion molding of expanded particles of a polyolefin-based resin, the relationship between the weight and volume of the returnable container satisfies Formula (1) below, and the relationship between the flexural modulus and density of the returnable container satisfies Formula (2) below:

$$650 \leqq (a-W)/W \times V \leqq 4{,}000 \quad (1)$$

(where W is the weight (kg) of the returnable container, V is the volume (L) of the returnable container, and a represents 23 kg, i.e., the maximum weight that can be carried by a worker within the plant, which is recommended by the National Institute for Occupational Safety & Health (NIOSH));

$$0.10 \leqq F/D \leqq 0.60 \quad (2)$$

(where D is the density (g/L) of the returnable container, and F is the flexural modulus (MPa) measured according to ISO 1209).

8. The returnable container for transporting parts according to claim 7, wherein a recessed portion serving as a finger insertion portion is provided on an outer surface of a sidewall, and the finger insertion portion and an upper end form a handle structure.

9. The returnable container for transporting parts according to claim 8, wherein the finger insertion portion has a shape in which the upper part of the finger insertion portion is concave with respect to the upper end side.

10. The returnable container for transporting parts according to claim 9, wherein the thickness between the upper surface of the finger insertion portion and the upper end is 30 to 50 mm, and the length from the upper end to the finger insertion portion is 65 to 90 mm.

11. The returnable container for transporting parts according to claim 7, wherein a finger insertion through-hole is provided on a sidewall, and the peripheral surface of the finger insertion through-hole is reinforced with a reinforcing member.

12. The returnable container for transporting parts according to claim 11, wherein the reinforcing member reinforcing the peripheral surface of the finger insertion through-hole is composed of a non-expanded resin or an expanded resin with a density of 120 g/L or more.

13. The returnable container for transporting parts according to claim 11, wherein the upper end of the opening of the finger insertion through-hole is located at a distance of 30 to 50 mm from the upper end of the sidewall, and the lower end of the opening of the finger insertion through-hole is located at a distance of 60 to 80 mm from the upper end of the sidewall.

* * * * *